US007470170B2

(12) United States Patent
Shimomura et al.

(10) Patent No.: US 7,470,170 B2
(45) Date of Patent: Dec. 30, 2008

(54) POLISHING PAD AND METHOD FOR MANUFACTURE OF SEMICONDUCTOR DEVICE USING THE SAME

(75) Inventors: Tetsuo Shimomura, Osaka (JP); Atsushi Kazuno, Osaka (JP); Kazuyuki Ogawa, Osaka (JP); Yoshiyuki Nakai, Osaka (JP); Masahiko Nakamori, Ohtsu (JP); Takatoshi Yamada, Ohtsu (JP)

(73) Assignee: Toyo Tire & Rubber Co., Ltd., Osaka (JP)

( * ) Notice: Subject to any disclaimer, the term of this patent is extended or adjusted under 35 U.S.C. 154(b) by 94 days.

(21) Appl. No.: 10/590,067

(22) PCT Filed: Feb. 22, 2005

(86) PCT No.: PCT/JP2005/002785

§ 371 (c)(1),
(2), (4) Date: Aug. 21, 2006

(87) PCT Pub. No.: WO2005/081300

PCT Pub. Date: Sep. 1, 2005

(65) Prior Publication Data

US 2007/0178812 A1 Aug. 2, 2007

(30) Foreign Application Priority Data

Feb. 23, 2004 (JP) ..... 2004-046411

(51) Int. Cl.
*B24B 1/00* (2006.01)

(52) U.S. Cl. ..... 451/41; 451/59; 451/533; 451/550

(58) Field of Classification Search ..... 51/297, 51/298; 451/36, 41, 59, 63, 533, 550
See application file for complete search history.

(56) References Cited

U.S. PATENT DOCUMENTS

| | | | | |
|---|---|---|---|---|
| 5,257,478 | A | 11/1993 | Hyde et al. | |
| 5,564,965 | A | 10/1996 | Tanaka et al. | |
| 7,267,607 | B2 * | 9/2007 | Prasad | 451/285 |
| 2002/0002026 | A1 * | 1/2002 | Molnar | 451/8 |
| 2004/0055223 | A1 | 3/2004 | Ono et al. | |
| 2004/0177563 | A1 * | 9/2004 | Prasad | 51/298 |
| 2004/0258882 | A1 * | 12/2004 | Prasad | 428/141 |
| 2005/0032464 | A1 * | 2/2005 | Swisher et al. | 451/41 |
| 2005/0064709 | A1 | 3/2005 | Shimomura et al. | |
| 2005/0277371 | A1 * | 12/2005 | Prasad | 451/285 |
| 2006/0046622 | A1 * | 3/2006 | Prasad | 451/41 |
| 2006/0148391 | A1 | 7/2006 | Ono et al. | |

FOREIGN PATENT DOCUMENTS

| | | |
|---|---|---|
| EP | 0658401 | 7/1995 |
| JP | 07-164307 | 6/1995 |
| JP | 2002-059357 | 2/2002 |
| JP | 2003-124161 | 4/2003 |
| JP | 2003-218074 | 7/2003 |
| JP | 2003-303794 | 10/2003 |
| JP | 2003-305635 | 10/2003 |
| WO | WO 91 14538 | 10/1991 |
| WO | WO 03/043071 | 5/2003 |

* cited by examiner

*Primary Examiner*—Timothy V Eley
(74) *Attorney, Agent, or Firm*—Hamre, Schumann, Mueller & Larson, P.C.

(57) ABSTRACT

The present invention provides a polishing pad which imparts excellent planarity and uniformity thereof to a material to be polished, such as a semiconductor wafer, without forming scratches. The present invention relates to a semiconductor wafer polishing pad comprising a polishing layer and a cushion layer, wherein the polishing layer is formed from foamed polyurethane, has a flexural modulus of 250 to 350 MPa, the cushion layer is formed from closed-cell foam and has a thickness of 0.5 to 1.0 mm and a strain constant of 0.01 to 0.08 μm/(gf/cm$^2$).

7 Claims, No Drawings

POLISHING PAD AND METHOD FOR MANUFACTURE OF SEMICONDUCTOR DEVICE USING THE SAME

FIELD OF THE INVENTION

The present invention relates to a polishing pad by which materials requiring a high degree of surface planarity, such as silicon wafers or optical materials, glass substrates for hard disks, resin plate or ceramic plate for recording an information and the like, can be flattened with stability and high uniformity. The polishing pad of the present invention can also be used particularly in a step of planarizing a silicon wafer, a semiconductor device having an oxide layer, a metal layer and the like formed on the silicon wafer. The present invention relates to a polishing pad which can provide excellent planarity and uniformity thereof by CMP (chemical mechanical polishing) of silicon wafer and the like to be polished and a method of producing a semiconductor device by using the polishing pad.

BACKGROUND OF THE INVENTION

Typical materials requiring a high degree of surface planarity include a single-crystalline silicon disk called a silicon wafer for producing semiconductor integrated circuits (IC, LSI). In a process for producing IC, LSI etc., the surface of the silicone wafer should be flattened highly accurately in a step of forming an oxide layer or a metal layer in order to provide reliable semiconductor connection with various films used in manufacturing circuits.

Generally, a polishing pad is stuck on a rotatable supporting disk called a platen in the polishing step, while a semiconductor wafer is fixed to a planetary disk called a polishing head. By rotational movement of the two and feeding polishing slurry containing micro particles (abrasive grains) emulsified to a gap between the polishing pad and the semiconductor wafer, the semiconductor wafer is polished and planarized. When the polishing pad moves on the surface of the wafer, the abrasive grains are pushed on the surface of the wafer at the contacting point. Therefore, the processed surface is polished by dynamic frictional effect between the surface of the wafer and abrasive grains. The polishing process is called as CMP polishing process.

As a polishing layer of the polishing pad used for highly accurately polishing, a foamed polyurethane sheet having a void volume of about 30 to 35% is generally used. Polyurethane foam sheet locally has excellent planarity, but the compressibility is within the range of 0.5 to 1.0%, which is small, and the cushioning properties are not sufficient. Thereby, it is difficult to uniformly apply a pressure on the whole surface of the wafer. Therefore, the polishing process is conducted by using a polishing pad comprising a soft cushion layer on the backside of the polyurethane foam sheet as a laminated polishing pad.

A polishing pad using a conventional polyurethane sheet provided with a cushion layer has the following problems.

(1) A nonwoven fabric having continuous pores impregnated with resin is widely used as the cushion layer, but there are problems such as variation among nonwoven fabrics and a change in compression characteristics due to immersion in slurry.

(2) A foamed urethane foam having independent pores comes to be used, but there are still problems such as difficult stabilization of a foamed state in production, significant residual strain resulting from the pores subjected to repeated loading, etc.

In order to solve the problems, as a polishing pad used during CMP process, various laminated polishing pad, such as (1) a polishing pad comprising a cushion layer having a compression recovery of not less than 90% (formed from a material having rubber elasticity), and a polishing layer laminated on the cushion layer (Japanese Patent Kokai Publication No. 305635/2003), (2) a polishing pad comprising a cushion layer having a volume modulus of not less than 60 MPa and a tensile modulus of 0.1 to 20 MPa, and a polishing layer having a contact angle to water of not more than 75 degrees, a flexural modulus of not less than 2 GPa and/or a surface hardness in durometer hardness of not less than 80 laminated on the cushion layer (Japanese Patent Kokai Publication No. 59357/2002), (3) an abrasive component a sheet foam formed from a soft elastomer and abrasive cloth laminated on the sheet foam (Japanese Patent Kokai Publication No. 164307/1995).

In Japanese Patent Kokai Publication No. 305635/2003, a main object is to reduce residual strain for compression load during polishing and reduce the change in compression properties of the polishing pad by using a cushion layer having a compression recovery of not less than 90% (formed from a material having rubber elasticity). Example of the laminated polishing pad, of which the polishing layer is formed from polyurethane resin (which polyurethane is selected is not disclosed), is described. The polishing pad has excellent uniformity within wafer and excellent planarity, but the abrasive rate is very low.

In Japanese Patent Kokai Publication No. 59357/2002, a polishing pad comprising a cushion layer having a volume modulus of not less than 60 MPa and a tensile modulus of 0.1 to 20 MPa, and a polishing layer having a contact angle to water of not more than 75 degrees, a flexural modulus of not less than 2 GPa and/or a surface hardness in durometer hardness of not less than 80 laminated on the cushion layer is disclosed. The excellent planarity is accomplished by using hard resin (such as a laminate using paper and or cloth as base material, or a composition formed by dispersing hydrophilic component in hard matrix resin) as a polishing layer, and the repression of scratch is accomplished by water wetting characteristics. However, the polishing layer has different order of hardness and flexural modulus from that of the present invention, and the cushion layers generally used are exemplified and non-foamed elastomers are disclosed as examples thereof. The polishing pad has excellent uniformity within wafer and excellent planarity, but the abrasive rate is very low.

In Japanese Patent Kokai Publication No. 164307/1995, an abrasive component a sheet foam formed from a soft elastomer and abrasive cloth laminated on the sheet foam is disclosed. As the sheet foam, closed-cell foam formed from natural rubber, synthetic rubber or thermoplastic elastomer is described, but a velour type non-woven fabric is disclosed as the abrasive cloth, which is different from the polishing layer material of the present invention.

OBJECTS OF THE INVENTION

A main object of the present invention is to provide a polishing pad which imparts excellent planarity and uniformity thereof to a material to be abraded, such as a semiconductor wafer without forming scratches, and method of producing semiconductor device by using the polishing pad.

According to the present invention, the object described above has been accomplished by using a foamed polyurethane as a polishing layer and using a closed-cell foam as a cushion layer laminated on the polishing layer in a polishing pad comprising the polishing layer and cushion layer, and adjusting a flexural modulus of the polishing layer and a thickness and strain constant of the cushion layer to specified ranges, thereby providing a polishing pad which imparts excellent planarity and uniformity thereof to a material to be abraded, such as a semiconductor wafer without forming scratches, and method of producing semiconductor device by using the polishing pad.

SUMMARY OF THE INVENTION

The present invention relates to a semiconductor wafer polishing pad comprising a polishing layer and a cushion layer, wherein the polishing layer is formed from foamed polyurethane, has a flexural modulus of 250 to 350 MPa, the cushion layer is formed from closed-cell foam and has a thickness of 0.5 to 1.0 mm and a strain constant of 0.01 to 0.08 μm/(gf/cm$^2$).

As a conventional cushion layer, the cushion layer having a thickness of about 1 to 2 mm and a strain constant of not less than 0.1 μm/(gf/cm$^2$) has been used. Planarity and uniformity has been secured by using the cushion layer, but since higher level of planarity has been recently required, it has been impossible to correspond to the requirement by the cushion layer described above. In order to obtain high planarity while maintaining good uniformity, it is required for the polishing layer to have high hardness, and have sufficient flexural properties in a macroscopic view to fit crinkle at the whole surface of the wafer. The present inventors have found that the flexural modulus of the polishing layer is within the range of 250 to 350 MPa as the most suitable range of the flexural properties.

Moreover, the present inventors have found that the strain constant and thickness of the cushion layer also have the most suitable ranges in order to obtain high planarity and uniformity within the above range of the flexural modulus, that is, the cushion layer has a thickness of 0.5 to 1.0 mm and strain constant of 0.01 to 0.08 μm/(gf/cm$^2$) in the present invention, which are different from the conventional cushion layer.

In order to put the present invention into a more suitable practical application, it is preferable that the foamed polyurethane have an average cell diameter of 1 to 70 μm;

the foamed polyurethane have a specific gravity of 0.5 to 1.0 g/cm$^3$;

the foamed polyurethane have a hardness of 45 to 65;

the foamed polyurethane have a compressibility of 0.5 to 5.0%; and the cushion layer be formed from at least one material selected from the group consisting of polyurethane resin and polyethylene resin.

Another embodiment of the present invention is a method of producing a semiconductor device comprising at least a step of polishing the surface of the semiconductor wafer by using the polishing pad of the present invention.

The present invention can provide a polishing pad which has much higher planarity than the conventional polishing pad, improves the abrasive rate and imparts excellent planarity and uniformity thereof to a material to be abraded, such as a semiconductor wafer without forming scratches, by using a foamed polyurethane as a polishing layer and using a closed-cell foam as a cushion layer laminated on the polishing layer in a polishing pad comprising the polishing layer and cushion layer, and adjusting a flexural modulus of the polishing layer and a thickness and strain constant of the cushion layer to specified ranges.

DETAILED DESCRIPTION OF THE PREFERRED EMBODIMENTS

The polishing pad of the present invention will be explained in detail hereinafter. The polishing pad of the present invention comprises a polishing layer and a cushion layer, which is softer than the polishing layer as described above. In the polishing pad of the present invention, it is required for the polishing layer to be formed from foamed polyurethane, and have a flexural modulus of 250 to 350 MPa, preferably 260 to 340 MPa, more preferably 270 to 330 MPa. When the flexural modulus of the polishing layer is lower than 250 MPa, uniformity within wafer is good, but planarity is not sufficiently obtained. On the other hand, when the flexural modulus of the polishing layer is higher than 350 MPa, the planarity is excellent, but the uniformity is not sufficiently obtained.

In the polishing pad of the present invention, it is required for the cushion layer to be formed from closed-cell foam and have a thickness of 0.5 to 1.0 mm and a strain constant of 0.01 to 0.08 μm/(gf/cm$^2$). The thickness of the cushion layer is preferably 0.6 to 0.9 mm, more preferably 0.7 to 0.85 mm. When the thickness of the cushion layer is smaller than 0.5 mm, high planarity is obtained, but the uniformity is largely degraded. On the other hand, when the thickness of the cushion layer is larger than 1.0 mm, the uniformity is good and the planarity in the general level is obtained as good as the conventional cushion layer, but high planarity, which is the main object of the present invention, is not sufficiently obtained.

The strain constant of the cushion layer is preferably 0.02 to 0.07 μm/(gf/cm$^2$), more preferably 0.03 to 0.06 μm/(gf/cm$^2$). When the strain constant is smaller than 0.01 μm/(gf/cm$^2$), the uniformity is not sufficiently obtained even if the thickness of the cushion layer is within the above range. On the other hand, when the strain constant is larger than 0.08 μm/(gf/cm$^2$), high planarity is not sufficiently obtained even if the thickness of the cushion layer is within the above range.

The technical effects of the present invention are to improve the abrasive rate and conduct polishing with excellent planarity and uniformity. In the polishing pad of the present invention, the technical effects of the present invention can be accomplished by satisfying the all subject matters described above, that is, accomplishing the properties of both the polishing layer and cushion layer. If the properties of one of these layers are out of the above range, the technical effects of the present invention are not obtained, even if the other of these layers has the properties within the above range.

In the polishing pad of the present invention, it is desired for the foamed polyurethane for the polishing layer to have an average cell diameter of 1 to 70 μm, preferably 5 to 50 μm. The average cell diameter is smaller than 1 μm, the technical effects of accumulating the slurry is not sufficiently obtained, which reduces the abrasive rate. On the other hand, when the average cell diameter is larger than 70 μm, the technical effects of accumulating the slurry is increased, and the abrasive rate is large, but the planarity is not sufficiently obtained.

In the polishing pad of the present invention, it is desired for the foamed polyurethane for the polishing layer to have a specific gravity of 0.5 to 1.0 g/cm$^3$, preferably 0.7 to 0.9 g/cm$^3$. When the specific gravity is lower than 0.5 g/cm$^3$, the strength of the surface of the polishing layer is reduced, and the planarity of the material to be abraded, such as a semiconductor wafer is degraded. On the other hand, when the specific gravity is higher than 1.0 g/cm$^3$, the number of the micro pore is reduced, and the planarity is good, but the planarity tends to be degraded.

In the polishing pad of the present invention, it is desired for the foamed polyurethane for the polishing layer to have a hardness of 45 to 65, preferably 45 to 60. When the hardness is lower than 45, the planarity of the material to be abraded is degraded. On the other hand, when the hardness is higher than 65, the planarity is good, but the uniformity within wafer tends to be degraded.

In the polishing pad of the present invention, it is desired for the foamed polyurethane for the polishing layer to have a compressibility of 0.5 to 5.0%, preferably 0.5 to 3.0%. When the compressibility is within the above range, both the planarity and uniformity can be sufficiently obtained.

The polishing pad of the present invention may have a light transmitting section for detecting an end point of polishing. If it has the light transmitting section, it is desired to have no unevenness, which accumulates and renews polishing solution, on the surface at the side of the polishing layer of the light transmitting section. If there is macroscopic unevenness on the surface at the side of the polishing layer of the light transmitting section, abrasive slurry comprising additives, such as abrasive grains is accumulated in the concave, and the scattering and absorbing of light occurs. Therefore, it tends to degrade the detection accuracy. In addition, it is also desired to have no macroscopic unevenness on the surface at the other side of the light transmitting section. If there is macroscopic unevenness as described above, the scattering of light easily occurs, and it tends to degrade the detection accuracy.

A material for forming light transmitting section in the polishing pad of the present invention is not limited as long as it has a light transmittance at a wave length of 600 to 700 nm of not less than 50%, and a compressibility higher than that of the polishing layer. Examples thereof include polyurethane resin, polyester resin, polyamide resin, acrylic resin, polycarbonate resin, halogen-based resin (such as polyvinyl chloride, polytetrafluoroethylene, polyvinylidene fluoride), polystyrene, olefin-based resin (polyethylene, polypropylene), epoxy resin and the like. These materials may be used alone or in combination of two or more thereof. Among these materials, the polyurethane resin having high abrasion resistance is preferably used, because it is possible to restrain the light scattering from the trace of dressing.

The polyurethane resin for forming light transmitting section comprises organic isocyanate, polyol and chain extender.

Examples of the organic isocyanates include 2,4-toluene diisocyanate, 2,6-toluene diisocyanate, 2,2'-diphenylmethane diisocyanate, 2,4'-diphenylmethane diisocyanate, 4,4,'-diphenylmethane diisocyanate, 1,5-naphthalene diisocyanate, p-phenylene diisocyanate, m-phenylene diisocyanate, p-xylylene diisocyanate and m-xylylene diisocyanate, hexamethylene diisocyanate, 1,4-cyclohexane diisocyanate, 4,4'-dicyclohexylmethane diisocyanate, isophorone diisocyanate and the like. These may be used alone or in combination of two or more thereof.

As the organic isocyanate, not only the diisocyanate compounds described above but also multifunctional (trifunctional or more) isocyanate compounds can be used. As the multifunctional isocyanate compounds, Desmodule-N (manufactured by Bayer) and a series of diisocyanate adduct compounds under the trade name of Duranate (Asahi Chemical Industry Co., Ltd.) are commercially available. Since the trifunctional or more isocyanate compounds used alone easily gel during synthesis of prepolymer, it is preferably added to diisocyanate compound to use.

Examples of the polyols include polyether polyol represented by polytetramethylene ether glycol, polyester polyol represented by polybutylene adipate, polycaprolactone polyol, polyester polycarbonate polyol, such as reaction product of polyester glycol (such as polycaprolactone) and alkylene carbonate, polyester polycarbonate polyol formed by reacting ethylene carbonate with polyhydroxy alcohol and then reacting the reaction mixture with organic dicarboxylic acid, polycarbonate polyol formed by ester exchange reaction of polyhydroxyl compound with aryl carbonate and the like. These may be used alone or in combination of two or more thereof.

Low molecular weight polyols, such as ethylene glycol, 1,2-propylene glycol, 1,3-propylene glycol, 1,4-butanediol, 1,6-hexanediol, neopentyl glycol, 1,4-cyclohexanedimethanol, 3-methyl-1,5-pentanediol, diethylene glycol, triethylene glycol, 1,4-bis(2-hydroxyethoxy)benzene can be used in addition to the above polyol.

Examples of the chain extenders include low molecular weight polyols, such as ethylene glycol, 1,2-propylene glycol, 1,3-propylene glycol, 1,4-butanediol, 1,6-hexanediol, neopentyl glycol, 1,4-cyclohexanedimethanol, 3-methyl-1,5-pentanediol, diethylene glycol, triethylene glycol, 1,4-bis(2-hydroxyethoxy)benzene; or polyamines such as 2,4-toluene diamine, 2,6-toluene diamine, 3,5-diethyl-2,4-toluene diamine, 4,4'-di-sec-butyl -diaminodiphenylmethane, 4,4'-diaminodiphenylmethane, 3,3'-dichloro-4,4'-diaminodiphenylmethane, 2,2',3,3'-tetrachloro- 4,4'-diaminodiphenylmethane, 4,4'-diamino-3,3'-diethyl-5,5'-dimethyldiphenylmethane, 3,3'-diethyl-4,4'-diaminodiphenylmethane, 4,4'-methylene-bis-methylanthranilate, 4,4'-methylene-bis-anthranilic acid, 4,4'-diaminodiphenylsulfon, N,N'-di-sec-butyl-p-phenylenediamine, 4,4'-methylene-bis(3-chloro-2,6diethylamine), 3,3'-dichloro-4,4'-diamino-5,5'-diethyldiphenylmethane, 1,2-bis(2-aminophenylthio)ethane, trimethylene glycol-di-p-aminobenzoate, 3,5-bis(methylthio)-2,4-toluene diamine. These may be used alone or in combination of two or more thereof. It is preferable to use the polyamines such that the addition thereof does not deteriorate the physical properties and light transmission properties of the light transmitting section, because the polyamines is colored themselves or resin using the polyamines is colored.

The ratio of the organic isocyanate, polyol and chain extender can suitably change depending to molecular weight of each component and the desired properties of the light transmitting section formed therefrom. In order to obtain the desired properties of the material for forming the light transmitting section, it is desired that a ratio of number of isocyanate group in the organic isocyanate to the total number of functional groups (hydroxyl group and amino group) in the polyol and chain extender be within the range of 0.95 to 1.15, preferably 0.99 to 1.10.

The polyurethane resin of the present invention can be produced by known urethane-making techniques, such as a melting method, a solution method etc., but in consideration of cost and working atmosphere, the polyurethane resin is formed preferably by the melting method.

The polyurethane can be produced by a prepolymer method or a one-shot method, but the prepolymer method wherein an isocyanate-terminated prepolymer synthesized previously from organic isocyanate and polyol is reacted with a chain extender is generally used. Since the isocyanate-terminated prepolymers produced from organic isocyanate and polyol are commercially available, if they are suitable to the present invention, it is possible to synthesize the polyurethane used in the present invention by a prepolymer method using the prepolymers.

A method of preparing the light transmitting section of the present invention is not limited, but may be well known method. A method of processing the polyurethane block produced by the method described above to a given thickness by a slicer of band saw type or planer type; a method of casting resin in a mold comprising a cavity having a given thickness to cure it; a method of using coating technique or sheet molding technique; and the like can be used. If the light transmitting section has cells, reflected light is damped by light scattering, and it tends to degrade detection accuracy of an end point of polishing and measurement accuracy of film thickness. Therefore, it is desired sufficiently to remove gas contained in the material before mixing by vacuating the material to not more than 10 Torr in order to remove the cells. In addition, in case of using a agitator type mixer, it is desired to stir the material at number of revolutions of not more than 100 rpm in order to prevent the cells from immixing in a step of stirring after mixing. It is also desired to conduct the stirring under a reduced pressure. It is also desired to stir and deaerate the material by using a planetary mixer, because it is difficult to immix the cells even if using the mixer at high revolution.

A shape of the light transmitting section is not limited, but it is desired to be the same shape as the opening of the polishing layer and cushion layer.

A size of the light transmitting section is not limited, but it is desired to be approximately the same size as the opening of the polishing layer and cushion layer.

In the polishing pad of the present invention, materials for the polishing layer are not limited as long as it is formed from foamed polyurethane and has a flexural modulus of 250 to 350 MPa. The reason why the foamed polyurethane is used for the polishing layer of the present invention is that abrasive slurry is accumulated in the cells on the surface of the polishing layer to increase the abrasive rate, or the polyurethane resin has excellent abrasion resistance, and polymers having desired physical properties are easily obtained by varying raw material composition.

The polyurethane resin for the polishing layer comprises organic isocyanate, polyol and chain extender as described for the light transmitting section.

The organic isocyanate used in the polyurethane resin for the polishing layer is not limited, but includes the organic isocyanate used in the polyurethane resin for the material for forming the light transmitting section.

The polyol used in the polyurethane resin for the polishing layer is not limited, but includes the polyol used in the polyurethane resin for the material for forming the light transmitting section. If using for the polyurethane resin for the polishing layer, a molecular weight of the polyol is not limited, but is preferably within the range of 500 to 2000 in view of elastic properties of the resulting polyurethane.

As the polyols, low molecular weight polyols, such as ethylene glycol, 1,2-propylene glycol, 1,3-propylene glycol, 1,4-butanediol, 1,6-hexanediol, neopentyl glycol, 1,4-cyclohexanedimethanol, 3-methyl-1,5-pentanediol, diethylene glycol, triethylene glycol, 1,4-bis(2-hydroxyethoxy)benzene can be used in addition to the high molecular weight polyol described above.

The ratio of the high molecular weight component to the low molecular weight component is determined depending to the performance requirement of the polishing layer obtained therefrom.

Examples of the chain extenders used in the polyurethane resin for the polishing layer include polyamines, such as 4,4'-methylene-bis(o-chloroaniline), 2,6-dichloro-p-phenylenediamine, 4,4'-methylene-bis(2,3-dichloroaniline). These may be used alone or in combination of two or more thereof.

The ratio of the organic isocyanate, polyol and chain extender can suitably change depending to molecular weight of each component and the desired properties of the polishing layer formed therefrom, but it is required to obtain the foam having a flexural modulus of 250 to 350 MPa. In order to obtain the polishing layer having excellent abrasive properties, it is desired that a ratio of number of isocyanate group in the organic isocyanate to the total number of functional groups (hydroxyl group and amino group) in the polyol and chain extender be within the range of 0.95 to 1.15, preferably 0.99 to 1.10.

The polyurethane resin for the polishing layer is prepared by the method as described in the polyurethane resin used in the material for forming the light transmitting section. The polyurethane resin may optionally contain stabilizers such as antioxidants, surfactants, lubricants, pigments, fillers, antistatic agents, and the other additives.

A method of micro foaming the polyurethane resin is not limited, but includes a method of adding hollow beads, mechanical foaming method, chemical foaming method and the like. These may be conducted in combination, but the mechanical foaming method using an active hydrogen group-free silicone-based surfactant consisting of a polyalkyl siloxane-polyether copolymer is more preferable. Examples of the silicone-based surfactants as suitable compound of the present invention include SH-192 (commercial available from Toray Dow Corning Silicone Co., Ltd.).

The method of preparing closed-cell type foamed polyurethane used in the polishing layer for the polishing pad of the present invention will be explained in detail hereinafter. The method of preparing the foamed polyurethane comprises the following steps (a) to (c).

(a) Stirring to prepare a cell dispersion of an isocyanate-terminated prepolymer;

A silicone-based surfactant is added to an isocyanate-terminated prepolymer and stirred in an inert gas, and the inert gas is dispersed as fine cells to form a cell dispersion. When the isocyanate-terminated prepolymer is in a solid form at ordinary temperatures, the prepolymer is melted by pre-heating to a suitable temperature.

(b) Mixing a curing agent (chain extender);

A chain extender is added to, and mixed with, the cell dispersion under stirring.

(c) Curing step

The isocyanate-terminated prepolymer mixed with the chain extender is cast in a mold, and heat-cured.

The inert gas used in production of the polyurethane resin foam is used for forming fine cells, and it is preferably not combustible. Examples of the gases include nitrogen, oxygen, a carbon dioxide gas, a rare gas such as helium and argon, and a mixed gas thereof, and the air dried to remove water is most preferable in view of cost.

As a stirrer for dispersing the inert gas in the silicone-based surfactant-containing isocyanate-terminated prepolymer to form fine cells, well known stirrers can be used without particular limitation, and examples thereof include a homogenizer, a dissolver, a twin-screw planetary mixer and the like. The shape of an agitator of the stirrer is not particularly limited either, but a whipper-type agitator is preferably used to form fine cells.

In a preferable embodiment, different stirrers are used in stirring for forming a cell dispersion in the stirring step and in stirring for mixing an added chain extender in the mixing step, respectively. In particular, stirring in the mixing step may not be stirring for forming cells, and a stirrer not generating large cells is preferably used. Such a stirrer is preferably a planetary mixer. The same stirrer may be used in the stirring step and the mixing step, and stirring conditions such as revolution rate of the agitator are preferably adjusted as necessary.

In the method of preparing the foamed polyurethane, heating and post-curing of the foam obtained after casting and reacting the cell dispersion in a mold until the dispersion lost fluidity are effective in improving the physical properties of the foam, and are extremely suitable. The cell dispersion may be cast in a mold and immediately post-cured in a heating oven, and even under such conditions, heat is not immediately conducted to the reactive components, and thus the diameters of cells are not increased. The curing reaction is preferably conducted at normal pressures to stabilize the shape of cells.

In the preparation of the polyurethane resin, a well known catalyst accelerating polyurethane reaction, such as tertiary amine-based catalyst, organotin-based catalysts, may be used. The type and amount of the catalyst added are determined depending to flow time in casting in a predetermined mold after the mixing step.

The production of the foamed polyurethane may be in a batch system where each component is weighed and introduced into a vessel, or in a continuous production system where each component and an inert gas are continuously supplied to and stirred in a stirring device and the resulting cell dispersion is removed to produce molded articles.

The polishing layer used for the polishing pad of the present invention is produced by cutting the foamed polyurethane prepared as described above into a predetermined size.

In the polishing layer formed from the foamed polyurethane of the present invention, it is desired to provide grooves for accumulating and renewing the abrasive slurry on the polishing surface (polishing zone) contact with a material to be polished. Since the polishing zone is formed from fine foam, there are many pores on the polishing surface, and it has a function to accumulate the abrasive slurry. In order to further effectively accumulate and renew the abrasive slurry or prevent the material to be polished from breaking by the absorption of the material to be polished, it is desired to have grooves on the polishing surface. The shape of the groove is not limited as long as it accumulate and renew the abrasive slurry, but includes, for example, XY grating groove, concentric circular groove, perforation, pore, column, cylinder, spiral groove, eccentric circular groove, radial groove and the combination thereof. The pitch, width and depth of the groove is not also limited, and can be suitably selected. The grooves have generally ordinality, but can vary the pitch, width and depth of the groove at every zone.

A method of forming the groove is not limited, but includes a method of mechanical cutting using, for example, a cutting tool of a predetermined size, method of casting resin in a mold having a given surface shape and curing it, a method of pressing resin using a press plate having a given surface shape, a method of forming the grooves by photolithography, a method of forming the grooves by printing, a method of forming the grooves by laser light using carbon dioxide laser and the like.

In the polishing pad of the present invention, it is desired for the polishing layer to have a thickness, which is not limited, of 0.5 to 4 mm, preferably 0.6 to 3.5 mm. Examples of the methods of preparing the polishing layer having the thickness include a method of processing the foam block produced by the method described above to a given thickness by a slicer of band saw type or planer type; a method of casting resin in a mold comprising a cavity having a given thickness to cure it; a method of using coating technique or sheet molding technique; and the like.

It is desired for the polishing layer to have a variability of thickness of not more than 100 μm, preferably not more than 50 μm. When the variability of thickness is larger than 100 μm, the polishing layer has large crinkle, and portions having different contact state are formed, which degrades the abrasive performance. In order to dissolve the variability of thickness, the surface of the polishing layer is dressed by dresser having abrasive grains of diamond electrodeposited or melt bonded thereon at initial stage of polishing. However, when the variability of thickness is larger than the upper limit, dressing time is long, which reduces the productive efficiency. In addition, in order to restrain the variability of thickness, the surface of the polishing zone adjusted to a given thickness may be buffing treated. The buffing treatment is preferably conducted stepwise by using abrasive sheets having different particle size.

A method of producing laminated polishing pad comprising a polishing layer and (light transmitting section and) cushion layer is not limited, and may be various methods, but examples thereof are as follows. Examples of the methods in case of having the light transmitting section are described as follows, but the polishing pad may be produced without forming an opening in case of having no light transmitting section.

In the first embodiment, a double-coated tape adheres to the polishing layer having a opening of a given size at a given position, and the cushion layer having a opening of a given size at the same position as the opening of the polishing layer adheres to the polishing layer with the double-coated tape. A double-coated tape bonding release paper then adheres to the cushion layer at the opposite side of the polishing layer, the light transmitting section is put in the opening of the polishing layer, and the polishing layer adheres to cushion layer.

In the second embodiment, a double-coated tape adheres to the polishing layer having a opening of a given size and the cushion layer adheres to the polishing layer with the double-coated tape. An opening is then formed in the double-coated tape and cushion layer at the same position and size as the opening of the polishing layer. A double-coated tape bonding a release paper at the opposite side adheres to the cushion layer, and a light transmitting section is put in the opening of the polishing layer and adheres thereto.

In the third embodiment, a double-coated tape adheres to the polishing layer having a opening of a given size and the cushion layer adheres to the polishing layer with the double-coated tape. A double-coated tape bonding a release paper at the opposite side of the cushion layer then adheres to the cushion layer. A opening is then formed from the double-coated tape to the release paper at the same position and size as the opening of the polishing layer. A light transmitting section is put in the opening of the polishing layer and adheres thereto. In the case, since the opposite side of the light transmitting section is open, it is desired to mount a component that prevents scrapes and the like from accumulating thereto.

In the fourth embodiment, a double-coated tape bonding a release paper at the opposite side of the cushion layer adheres to the cushion layer, and an opening is then formed from the cushion layer to the release paper. A double-coated tape adheres to the polishing layer having a opening of a given size, and the polishing layer adheres to the cushion layer with the double-coated tape so as to adjust the opening of the cushion layer to the opening of the polishing layer. A light transmitting section is put in the opening of the polishing layer and adheres thereto. In the case, since the opposite side of the polishing layer is open, it is desired to mount a component that prevents scrapes and the like from accumulating thereto.

In a method of producing the polishing pad of the present invention, means of forming an opening are not limited, but include a method of forming an opening by pressing using a cutting tool, a method of forming an opening by using laser, such as carbon dioxide laser, a method of forming an opening by cutting using, for example, a cutting tool and the like. The size and shape of the opening of the polishing layer is not limited.

In the polishing pad of the present invention, the cushion layer compensates the properties of the polishing layer, and as the main object of the present invention, the improvement of the abrasive rate, the planarity and uniformity within wafer are accomplished by the properties of both the polishing layer and cushion layer. It is required for the cushion layer to be formed from closed-cell foam and have a thickness of 0.5 to 1.0 mm and a strain constant of 0.01 to 0.08 μm/(gf/cm$^2$). The cushion layer is required in order to accomplish both the planarity and uniformity within wafer, which are relation of a trade-off. The planarity means smoothness in a pattern portion when a material to be polished having micro unevenness formed during forming the pattern is polished, the uniformity within wafer means uniformity in the whole material to be polished.

In the polishing pad of the present invention, the cushion layer is not limited as long as it is formed from closed-cell foam and has a thickness of 0.5 to 1.0 mm and a strain constant of 0.01 to 0.08 μm/(gf/cm$^2$), but includes, for example, closed-cell foam of polymer resin, such as polyurethane resin, polyethylene resin.

The polyurethane resin is selected from the polyurethane resin described in the production of the light transmitting section so as to have the above described properties, and the closed-cell foam is formed by using the selected resin. A method of forming the closed-cell foam may be selected from the methods described as the method of producing the polishing layer.

In the present invention, methods of bonding the polishing layer to the cushion layer include, for example, a method of positioning a double-coated tape between the polishing layer to the cushion layer, and pressing it.

A double-coated tape comprises adhesive layers on the both surface of a substrate, such as nonwoven fabric and film. It is desired to use the film as a substrate in order to prevent the abrasive slurry from penetrating into the cushion layer. In addition, examples of the compositions for the adhesive layer include rubber-based adhesive, acrylic-based adhesive and the like. In view of the metal ion content, preferred is the acrylic-based adhesive, because it has small content of the metal ion. Since the composition of the polishing layer may be different from that of the cushion layer, each adhesive layer of the double-coated tape can have different composition and adjust the adhesion of the each adhesive layer to suitable range.

Examples of means of bonding the cushion layer to the double-coated tape include a method of pressing the double-coated tape on the cushion layer to bond it. The double-coated tape comprises adhesive layers on the both surface of a substrate, such as nonwoven fabric and film as described in the double-coated tape for bonding the polishing layer to the cushion layer. Since the double-coated tape is removed from the platen after using the polishing pad, it is desired to use the film for the substrate, because it is possible to dissolve the remain of the tape on the cushion layer. The same compositions for the adhesive layer as that of the double-coated tape for bonding the polishing layer to the cushion layer can be used.

Semi-conductor device is produced through the step of polishing the surface of semi-conductor wafer by using the polishing pad. The semi-conductor wafer is generally formed by depositing wire metal and oxide film on silicon wafer. A method of polishing the semi-conductor wafer and polishing apparatus are not limited, but the method is conducted by using the polishing apparatus comprising, for example, a polishing platen for supporting a polishing pad, a supporting stand (polishing head) for supporting a semi-conductor wafer, a backing for uniformly applying pressure to the wafer and an abrasive slurry-feeding mechanism. The polishing pad is mounted on the polishing platen by bonding with a double-coated tape. The polishing platen and supporting stand are positioned such that the polishing pad and semi-conductor wafer supported by the platen and the stand respectively are opposed to each other, and have an axis of revolution respectively. At the side of the supporting stand, a pressing mechanism for pushing the semi-conductor wafer onto the polishing pad is provided. During polishing, the semi-conductor wafer is pushed onto the polishing pad while rotating the polishing platen and supporting stand, and the polishing is conducted while feeding the abrasive slurry. Feed of the abrasive slurry, polishing load, revolution number of the polishing platen and revolution number of the semi-conductor wafer, which are not limited, are adjusted to suitable range.

Thereby, a projective portion on the surface of the semi-conductor wafer is smoothly polished. After the polishing, dicing, bonding, packaging and the like are conducted, and semi-conductor device is produced. The semi-conductor device is used for processor, memory and the like.

EXAMPLES

Hereinafter, the present invention is described in more detail by reference to the Examples, but the present invention is not limited by the Examples.

(Strain Constant)

The cushion layer was cut into-a disk having a diameter of 0.5 inch and used as a sample for measuring strain constant. The compression amount and load of the sample was measured at a temperature of 23° C.±2° C. and humidity of 60%±10% with an universal testing machine (Model 5848 manufactured by Instron) at compression speed of 0.1 mm/min. The strain constant was determined by the calculation from the inclination of a line obtained from proximate analysis of plots of compression load 300 gf/cm$^2$ and 1000 gf/cm$^2$ in the resulting graph of compression load vs. compression amount.

(Compressibility)

The material for the polishing layer, which cut into disk having a diameter of 7 mm, was used as a sample for measuring the compressibility, the sample was left at a temperature of 23° C.±2° C. and humidity of 50%±5% for 40 hours. The compressibility was measured by using TMA (SS6000; manufactured by Seiko Instruments). The compressibility is determined by using the following formula:

$$\text{Compressibility (\%)}=[(T_1-T_2)/T_1]\times 100$$

wherein $T_1$ represents the thickness of a sample after application of 30 kPa (300 g/cm$^2$) stress for 60 seconds to the sample, and $T_2$ represents the thickness of the sample after application of 180 kPa stress for 60 seconds to the sample in the state $T_1$.

(Flexural Modulus)

The polishing layer was cut into a sample for measuring the flexural modulus having a thickness of 2.0 mm, width of 10 mm and length of 50 mm. The flexural modulus of the sample was measured with an autograph (Tensilone UTM-4LH manufactured by Toyo Baldwin) at a distance between chucks of 32 mm and crosshead speed of 2 mm/min, according to JIS K7171. The average of three measurements was shown as the flexural modulus of the sample.

(Average Cell Diameter)

In measurement of average cell diameter, the material, such as the polishing layer was cut into a thickness of about 1 μm parallel to the layer with a microtome cutter as a sample for measuring the average cell diameter. The sample was mounted on a slide glass, and the diameter of the all cells was measured at an optional 0.2 mm×0.2 mm square area by using an image processing unit (Image Analyzer V10 manufactured by TOYOBO Co., Ltd.) to calculate the average cell diameter.

(Specific Gravity)

The specific gravity was measured according to JIS Z8807-1976. The material, such as the polishing layer was cut into a strip sized of 4 cm×8.5 cm (a proper thickness) as a sample for measuring the specific gravity, and the sample was left at a temperature of 23° C.±2° C. and humidity of 50%±5% for 16 hours. The specific gravity was measured by using a hydrometer (Sartorius K.K.).

(Hardness)

The hardness was measured according to JIS K6253-1997. The material, such as the polishing layer was cut into a size of 2 cm×2 cm (a proper thickness) as a sample for measuring the hardness, and the sample was left at a temperature of 23° C.±2° C. and humidity of 50%±5% for 16 hours. The hardness was measured by using a stack of the samples having a thickness of not less than 6 mm with a hardness meter (Asker D hardness meter manufactured by Kobunshi Keiki Co., Ltd.).

(Evaluation of Polishing Characteristics)

As the polishing apparatus, SPP600S manufactured by Okamoto Machine Tool Works, Ltd. was used in evaluation of polishing characteristics of the resulting polishing pad.

(Abrasive Rate)

The abrasive rate was determined by the calculation from a time until polishing 0.5 μm thickness of thermal-oxide film from 1 μm thickness of the oxide film from the oxide film formed on silicon wafer having a diameter of 8 inches. The thickness of an oxide film was measured by an interference film thickness measuring device manufactured by Otsuka Denshisha. The polishing conditions were as follows: silica slurry SemiSperse-12 (manufactured by Cabot) was dropped at a flow rate of 150 ml/min., the polishing loading was 350 g/cm$^2$, the number of revolutions of the polishing platen was 35 rpm, and the number of revolutions of the wafer was 30 rpm.

(Uniformity Within Wafer)

After polishing, the thickness of the film was measured at 25 points on the polished surface of a silicon wafer. The maximum thickness Tmax and minimum thickness Tmin of the film were used to calculate uniformity (%) according to the following equation:

$$\text{Uniformity Within Wafer (\%)}=(T\max-T\min)/(T\max+T\min).\times 100$$

The smaller the value of the uniformity is, the higher the uniformity within the surface of the silicon wafer is.

(Planarity)

For evaluation of planarity, a 0.5 μm thermal-oxide film was deposited on a 8-inch silicon wafer and subjected to patterning, and a 1 μm oxide film p-TEOS (tetraethoxy silane) was further deposited thereon, to prepare a wafer having a pattern with an initial difference in level of 0.5 μm. This wafer was polished under the above-described conditions, and each difference in level was measured to evaluate the planarity. The planarity was determined by measuring the two differences in level. One is a local difference in level, which is level difference in the pattern where lines having a width of 270 μm were spaced at 30 μm, that is, the difference in level after 1 minute from polishing. The other is the abrasive amount in 270 μm space when the global difference in level between tops of lines in two patterns, which are a pattern where lines having a width of 270 μm is spaced at 30 μm and a pattern where lines having a width of 30 μm is spaced at 270 μm, was reduced to 2000 Å or less was measured to evaluate the planarity. The smaller the local difference in level, the higher the speed of planarizing unevenness of the oxide film formed depending to the pattern on the wafer within a certain time. The smaller the abrasive amount in the space, the smaller the abrasive amount of the portion not to be polished, and it is shown that the planarity is excellent.

Example 1

Polyurethane-based thermoplastic elastomer E568 (manufactured by Nippon Miractran, Shore D hardness: 68) was extruded into a sheet having a width of 650 mm and thickness of 1.5 mm by using a extruder, and cut off into a length of 650 mm, that is, the sheet sized in 650 mm×650 mm×1.5 mm was obtained. The sheet was left in pressured vessel maintaining the temperature of 40° C. and pressure of 15 MPa under carbon dioxide atmosphere for 24 hours, and the sheet was sufficiently impregnated with carbon dioxide. The sheet was taken out from the vessel, placed-into two Teflon sheets heated to 80° C., and immediately put into an oil bath of 145° C. and dipped for 40 seconds to foam it. The resulting foamed sheet was buffed with a buff to form a polishing layer sheet having a thickness of 1.3 mm. The polishing layer has a specific gravity of 0.76 g/cm$^3$, average cell diameter of 18 μm, hardness of 47, flexural modulus of 255 MPa, and compressibility of 1.3%.

Concentric circular grooves having a depth of 0.4 mm, width of 0.25 mm and pitch of 1.5 mm were formed on one side of the polishing layer sheet by using a surface groove processing machine (Toho Engineering), and the polishing layer was formed into a disk having a diameter of 24 inches (610 mm).

The cushion layer having a thickness of 0.8 mm and a strain constant of 0.07 μm/(gf/cm$^2$), which was formed from closed-cell foamed polyurethane resin and formed into a disk having a diameter of 24 inches (610 mm), was prepared. The cushion layer adhered to the polishing layer with a double-coated tape (Double-tack tape #5782 manufactured by Sekisui Chemical Co., Ltd.), and a double-coated tape for the platen (Double-tack tape #5784 manufactured by Sekisui Chemical Co., Ltd.) adhered to the opposite side of the cushion layer to prepare a polishing pad.

Comparative Example 1

100 parts by weight of a polyether-based prepolymer (Adiprene L-325 manufactured by Uniroyal, NCO content: 2.22 meq/g) filtered and 3 parts by weight of a silicone-based nonionic surfactant (SH192 manufactured by Toray Dow Corning Silicone Co., Ltd.) were introduced into a fluorine coated vessel and mixed, and the temperature was maintained to 80° C. The mixture was vigorously stirred for about 4 minutes at about 900 rpm by using a fluorine coated stirrer with introducing air into reaction process. 26 parts by weight of 4,4'-methylene-bis(o-chloroaniline) (Ihara Cuamine MT manufactured by Ihara Chemical Industry) previously melted at 120° C. and filtered was introduced thereto. After stirring for about 1 minute, the mixed reaction solution was introduced into a fluorine coated pan-type open mold. When the reaction solution did not flow, the mold was put in an oven and post-cured at 110° C. for 6 hours to produce a foamed polyurethane resin block. This foamed polyurethane resin block was sliced by a slicer of band saw type (manufactured by Fecken) to obtain a foamed polyurethane resin sheet. The sheet was buffing treated with a buff (manufactured by Amitec) to form a sheet having the desired thickness (sheet thickness: 1.27 mm). The buffing treated sheet was punched into a disk having a diameter of 24 inches (610 mm), and concentric circular grooves having a depth of 0.4 mm, width of 0.25 mm and pitch of 1.5 mm were formed on the surface of the sheet by using a surface groove processing machine (Toho Engineering) to prepare the polishing layer. The resulting polishing layer has an average cell diameter of 45 μm, a specific gravity of 0.87 g/cm$^3$, hardness of 53, compressibility of 1.0% and flexural modulus of 260 MPa.

The cushion layer having a thickness of 1.3 mm and a strain constant of 0.14 μm/(gf/cm$^2$), which was formed from closed-cell foamed polyethylene resin and formed into a disk having a diameter of 24 inches (610 mm), was prepared. The cushion layer adhered to the polishing layer with a double-coated tape (Double-tack tape #5782 manufactured by Sekisui Chemical Co., Ltd.), and a double-coated tape for the platen (Double-tack tape #5784 manufactured by Sekisui Chemical Co., Ltd.) adhered to the opposite side of the cushion layer to prepare a polishing pad.

Comparative Example 2

The cushion layer having a thickness of 0.4 mm and a strain constant of 0.13 μm/(gf/cm$^2$), which was formed from closed-cell foamed polyurethane resin and formed into a disk having a diameter of 24 inches (610 mm), was prepared. The cushion layer laminated to the polishing layer used in Example 1 as described in Comparative Example 1 to prepare a polishing pad.

Comparative Example 3

The polishing pad was prepared except that 20 parts by weight of a silicone-based nonionic surfactant was used. The resulting polishing layer has an average cell diameter of 25 μm, a specific gravity of 0.7 g/cm$^3$, hardness of 40, compressibility of 2.0% and flexural modulus of 170 MPa. The cushion layer used in Example 1 laminated to the polishing layer as described in Example 1 to prepare a polishing pad.

The polishing characteristics of the polishing pads of Example 1 and Comparative Examples 1 to 3 were evaluated. The results are shown in the following Table 1. The polishing pad of Example 1 has sufficient abrasive rate, uniformity within wafer and planarity.

On the other hand, in the polishing pad of Comparative Example 1, the abrasive rate and uniformity within wafer were less than the polishing pad of Example 1, but it is within the sufficient range. However, the planarity of the polishing pad of Comparative Example 1 was out of the sufficient range.

In the polishing pad of Comparative Example 2, the abrasive rate and planarity were less than the polishing pad of Example 1, but it is within the sufficient range. However, the uniformity within wafer of the polishing pad of Comparative Example 1 was largely degraded.

In the polishing pad of Comparative Example 3, the uniformity within wafer was very good, but the abrasive rate and planarity were largely degraded.

TABLE 1

| Sample No. | Abrasive rate (Å/min) | Uniformity within wafer (%) | Planarity (nm) |
|---|---|---|---|
| Example 1 | 2200 | 5.6 | 20 |
| Comparative Example 1 | 2100 | 3.5 | 95 |
| Comparative Example 2 | 2100 | 15.0 | 22 |
| Comparative Example 3 | 1600 | 3.3 | 150 |

What is claimed is:

1. A semiconductor wafer polishing pad comprising a polishing layer and a cushion layer, wherein the polishing layer is formed from foamed polyurethane and has a flexural modulus of 250 to 350 MPa, and the cushion layer is formed from closed-cell foam and has a thickness of 0.5 to 1.0 mm and a strain constant of 0.01 to 0.08 μm/(gf/cm$^2$).

2. The polishing pad according to claim 1, wherein the foamed polyurethane has an average cell diameter of 1 to 70 μm.

3. The polishing pad according to claim 1, wherein the foamed polyurethane has a specific gravity of 0.5 to 1.0 g/cm$^3$.

4. The polishing pad according to claim 1, wherein the foamed polyurethane has a Shore D hardness of 45 to 65.

5. The polishing pad according to claim 1, wherein the foamed polyurethane has a compressibility of 0.5 to 5.0%.

6. The polishing pad according to claim 1, wherein the cushion layer is formed from at least one material selected from the group consisting of polyurethane resin and polyethylene resin.

7. A method of producing a semiconductor device comprising at least a step of polishing a surface of a semiconductor wafer by using the polishing pad according to claim 1.

* * * * *